US008393436B2

(12) United States Patent
Tomerlin et al.

(10) Patent No.: US 8,393,436 B2
(45) Date of Patent: Mar. 12, 2013

(54) FLEXIBLE MUFFLER FOR USE IN AIRCRAFT ENVIRONMENTAL CONTROL SYSTEMS AND METHOD OF MANUFACTURE

(75) Inventors: Reg Tomerlin, Los Angeles, CA (US); Allen W. Harwood, Fountain Valley, CA (US); Richard Hoff, Santa Ana, CA (US); David Boyer, Huntington Beach, CA (US)

(73) Assignee: Arrowhead Products Corporation, Los Alamitos, CA (US)

( * ) Notice: Subject to any disclaimer, the term of this patent is extended or adjusted under 35 U.S.C. 154(b) by 0 days.

(21) Appl. No.: 13/066,503

(22) Filed: Apr. 15, 2011

(65) Prior Publication Data

US 2012/0261211 A1 Oct. 18, 2012

(51) Int. Cl.
*F16L 11/26* (2006.01)

(52) U.S. Cl. ..... 181/222; 138/129

(58) Field of Classification Search ..... 181/222, 181/224, 225, 246; 381/122, 125, 129
See application file for complete search history.

(56) References Cited

U.S. PATENT DOCUMENTS

| | | | | |
|---|---|---|---|---|
| 3,362,434 | A * | 1/1968 | Medford et al. | 138/122 |
| 5,482,089 | A * | 1/1996 | Weber et al. | 138/122 |
| 5,548,093 | A * | 8/1996 | Sato et al. | 181/224 |
| 5,607,529 | A * | 3/1997 | Adamczyk et al. | 156/143 |
| 5,731,557 | A * | 3/1998 | Norres et al. | 181/233 |
| 5,901,754 | A * | 5/1999 | Elsasser et al. | 138/118 |
| 6,062,270 | A * | 5/2000 | Hultberg et al. | 138/129 |
| 6,105,620 | A * | 8/2000 | Haberl | 138/118 |
| 6,152,186 | A * | 11/2000 | Arney et al. | 138/129 |
| 6,161,591 | A * | 12/2000 | Winter et al. | 138/121 |
| 6,253,873 | B1 * | 7/2001 | Norres et al. | 181/224 |
| 6,354,332 | B1 * | 3/2002 | Burkhardt et al. | 138/109 |
| 6,386,316 | B1 * | 5/2002 | Lepoutre | 181/224 |
| 6,491,067 | B1 * | 12/2002 | Davenport et al. | 138/110 |
| 6,948,479 | B1 * | 9/2005 | Raney et al. | 123/456 |
| 7,546,899 | B2 * | 6/2009 | Tomerlin et al. | 181/252 |
| 2001/0015302 | A1 * | 8/2001 | Lundgren | 181/252 |
| 2003/0075228 | A1 * | 4/2003 | Tippett | 138/125 |
| 2003/0172981 | A1 * | 9/2003 | Gibson | 138/131 |
| 2003/0178085 | A1 * | 9/2003 | Burke et al. | 138/138 |
| 2007/0235100 | A1 * | 10/2007 | Tomerlin et al. | 138/112 |
| 2010/0044149 | A1 * | 2/2010 | Patel et al. | 181/224 |

* cited by examiner

*Primary Examiner* — Jeremy Luks
(74) *Attorney, Agent, or Firm* — Roy A. Ekstrand

(57) ABSTRACT

A flexible muffler for use in an aircraft environmental system includes a flexible body having a porous inner layer and an air impervious outer layer both supported by a helically wound adhesively attached reinforcing cord. The flexible body includes a pair of connecting end caps at opposed ends thereof which are joined to the flexible body in an air tight attachment. The resulting muffler provides acoustic energy absorptive and is readily flexed and bent to accommodate space restrictions within the environmental control system of the aircraft.

8 Claims, 4 Drawing Sheets

FLEXIBLE MUFFLER FOR USE IN AIRCRAFT ENVIRONMENTAL CONTROL SYSTEMS AND METHOD OF MANUFACTURE

FIELD OF THE INVENTION

This invention relates generally to environmental control system for use in vessels such as aircraft and particularly to muffler apparatus utilized therein for reducing and controlling sound within the environmental control system. The invention relates further to methods of manufacture of such mufflers.

BACKGROUND OF THE INVENTION

Commercial and private aircraft typically utilize flexible air ducting systems for the movement and transport of air throughout the occupied and pressurized cabin and cockpit areas. These systems, generally referred to as environmental control systems, utilize airflow ducts to circulate filtered low pressure air which has typically been chemically and thermally conditioned. Because such ducting must pass through a virtual labyrinth of aircraft structural components and aircraft systems, typical ducting systems are multiply-curved and often "snake-like" in design and shape. To provide this multiply-curved structure, the majority of aircraft ducting systems are typically fabricated of a combination of rigid and flexible duct components.

For the most part, currently available ducting systems are more or less effective in transporting conditioned air throughout the occupied cockpit and cabin areas of the aircraft. Unfortunately, the ducting networks within the aircraft environmental control systems also tend to function as carriers and conductors of noise throughout the cabin and cockpit areas. Within a typical aircraft in flight, noise is generated internally within the environmental control system by a variety of sources including circulation fans, valves, connectors, rough interior duct walls, turbulence at points of duct connection and differently sized orifices within the system used to constrict and meter air flow. Externally, additional low and mid frequency noises generated by other aircraft operating systems such as hydraulic pumps engine sounds etc often pass through or are communicated to the walls of the environmental control system ducts and into the duct passages themselves. As a result, a difficulty arises in designing an environmental control system which meets all systemic demands of proper air flow and circulation without also allowing undesirable noise levels to be generated, introduced, or otherwise carried into cabin areas.

Noise within aircraft cabin and cockpit areas can be extremely distracting and annoying. In the extreme, unrestricted noises from environmental control system sources may represent a health hazard to air crew and passengers alike and may greatly add to the fatigue of air travel and aircraft operation.

Unfortunately, noise within an operating aircraft is inevitable. The task therefore for environmental control system designers is to minimize the amount of noise carried by or created within the environmental control system duct work. To reduce noise transmission within environmental control system ducts, practitioners in the art position mufflers or noise intenuating devices within the environmental control system ducting at critical points. The objective of such mufflers is to reduce the noise level carried by low pressure air passing through and being discharged from the environmental control system duct. In many aircraft, as many as one hundred or more muffler devices may be utilized within the environmental control system. Accordingly, such muffler devices represent a significant portion of the cost and weight attributed to the environmental control system of the aircraft. Thus, environmental control systems become a significant cost and weight entity in aircraft design.

As a general statement, the material used on aircraft are all subject to overriding requirements of reduced weight and reduced flammability. Weight reduction relates generally to criteria such as performance, strength and cost efficiency while reduced flammability relates to criteria concerning safety. While both weight reduction and reduced flammability are desirable, they are often in opposition. Materials such as metal are excellent for flammability and strength but are often prohibitive in weight compared to other materials. Thus, to reduce weight, many systems and system components within an aircraft must for all practical purposes be fabricated from non-metal materials. Unfortunately, most non-metal materials tend to be flammable and combustible.

The environmental control system of an aircraft and the components used therein are as a result of weight considerations fabricated largely of non-metal materials. In most environmental control systems, components such as mufflers or the like are fabricated of non-metal flammable material and as a result increase the combustible flammable material within the aircraft. The extent of combustible and flammable material aboard and aircraft is often referred to as its "fuel loading". Materials which are combustible and/or flammable are described as materials which increase fuel loading. Many materials currently used in aircraft mufflers and similar components such as silicone rubber are flammable and therefore require the addition of fire retardants which can reduce fuel loading but which also increase the duct system weight and reduce the mechanical properties of the fabricated muffler. As a result, there exists a direct relationship between the weight of environmental control system mufflers and their flammability. In essence, this relationship relates to the quanta of potentially flammable material (or fuel) which are provided by the muffler to an aircraft fire.

Because aircraft environmental control systems and the mufflers therein contain a continuous flow of air, an onboard fire within the aircraft may be increased by this air flow. Therefore, fires within or near the components of the environmental control system such as mufflers are particularly hazardous. It is desirable therefore to reduce the weights of components such as mufflers and the like to achieve not only the anticipated efficiency of weight reduction but also to improve the flammability hazard within the environmental control system and the aircraft generally.

In attempting to minimize the fire hazard aboard an aircraft, several design criteria and constraints have been imposed upon the ducting systems of aircraft environmental control apparatus. These design criteria and constraints originate generally from governmental and industrial regulations imposed upon aircraft fabrication. Many of these regulations focus upon the safety of aircraft passengers and personnel in the event of an aircraft fire. These constraints include attention to flammability, toxicity and smoke generation during an aircraft fire. Recognizing the need for safety and protection of crew and passengers in the event of aircraft fires, the federal aviation authority (FAA) has implemented a succession of standards and regulation for materials utilized within aircraft environmental control systems. A new and currently developing flammability test is likely to be implemented and is generally referred to as "new radiant panel test" (NRPT) which presents a high standard relative to flammability.

In attempting to meet the complex and often conflicting requirements of environmental control system muffler design, practitioners in the art have provided a variety of systems and devices. For example, U.S. Pat. No. 7,546,899 issued to Tomerlin et al sets forth a LIGHTWEIGHT POLYMER MUFFLER APPARATUS AND METHOD OF MAKING SAME in which a muffler includes a thin wall polyether ether ketone (PEEK) cover tube, an open cell polymer actuator tube slip fit their into and polymer end fitting securing the tubes together and forming a pneumatic seal there between.

U.S. Pat. No. 6,105,620 issued to Haberl sets forth a FLEXIBLE TUBE DEVICE which is bendable and which has the capability of substantially maintaining its shape as bending forces are released. The device is characterized in that it includes a flexible part including a flexible inner hose or a flexible outer hose which may surround the inner hose.

Published patent application US2010/0044149A1 filed on behalf of Patal et al sets forth an ACCOUSTIC MANAGEMENT OF FLUID FLOW WITHIN A DUCT in which sound-dampening apparatus is provided consisting of a duct through which fluid flows such as an air duct. A flexuous cord is helically wound around the inner or outer surface of the duct at a pitch corresponding to a selected acoustical frequency range associated with the fluid flow through the duct.

In a generally related art, U.S. Pat. No. 5,482,089 issued to Weber et al sets forth a FLEXIBLE CONDUIT FOR THE EXHAUST LINE FOR AN INTERNAL COMBUSTION ENGINE which utilizes a flexible supple tube having several helical corrugations of equal pitch and a flexible supporting coil spring both connected to support flanges is provided.

While the foregoing described prior art devices have to some extent improved the art, there remains none the less a continuing need in the art for ever more effective and cost efficient mufflers and methods of manufacture therefore.

SUMMARY OF THE INVENTION

Accordingly, it is a general object of the present invention to provide an improved muffler for use in environmental control systems of vessels such as aircraft or the like. It is a more particular object of the present invention to provide an improved muffler for use in aircraft environmental control systems which provides reduced flammability, greater strength and which is lighter in weight. It is a still further object of the present invention to provide an improved muffler for use in an aircraft environmental system which is flexible and may be shaped without constriction of its internal air passage.

In accordance with the present invention, there is provided for use in an aircraft environmental control system, a flexible muffler comprising a pair of duct connectors; an inner sleeve formed of a sound pervious material having opposed ends joined to the duct connectors and defining a muffler passage therethrough; a first helix of reinforcing cord would upon the inner sleeve; a layer of acoustic absorptive material upon the inner sleeve and the first helix of reinforcing cord; an outer sleeve formed of an air impervious material having opposed ends joined to the duct connectors and forming a seal therewith; and a second helix of reinforcing cord wound upon the outer sleeve, the inner and outer sleeves and the first and second helixes of reinforcing cord cooperating to maintain the muffler passage in an open state when the flexible muffler is flexed or bent.

The invention further provides a method of making a flexible muffler comprising the steps of: providing a first mandrel; forming an inner sleeve of sound pervious material upon the first mandrel; winding a first helix of adhesive coated reinforcing cord upon the inner sleeve; curing the adhesive coated upon the first helix of reinforcing cord to form an attachment of the first helix of reinforcing cord upon the inner sleeve to form an inner sleeve assembly having opposed ends; providing a second mandrel larger than the first mandrel; forming an outer sleeve of air impervious material upon the second mandrel; winding a second helix of adhesive coated reinforcing cord upon the outer sleeve; curing the adhesive coated upon the second helix of reinforcing cord to form an attachment of the second helix of reinforcing cord upon the outer sleeve to form an outer sleeve assembly having opposed ends; placing acoustic absorptive material upon the inner sleeve assembly; placing the outer sleeve assembly upon the acoustic absorptive material; providing a pair of duct connectors; and joining the pair of duct connectors to the opposed ends of the inner sleeve assembly and the outer sleeve assembly.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
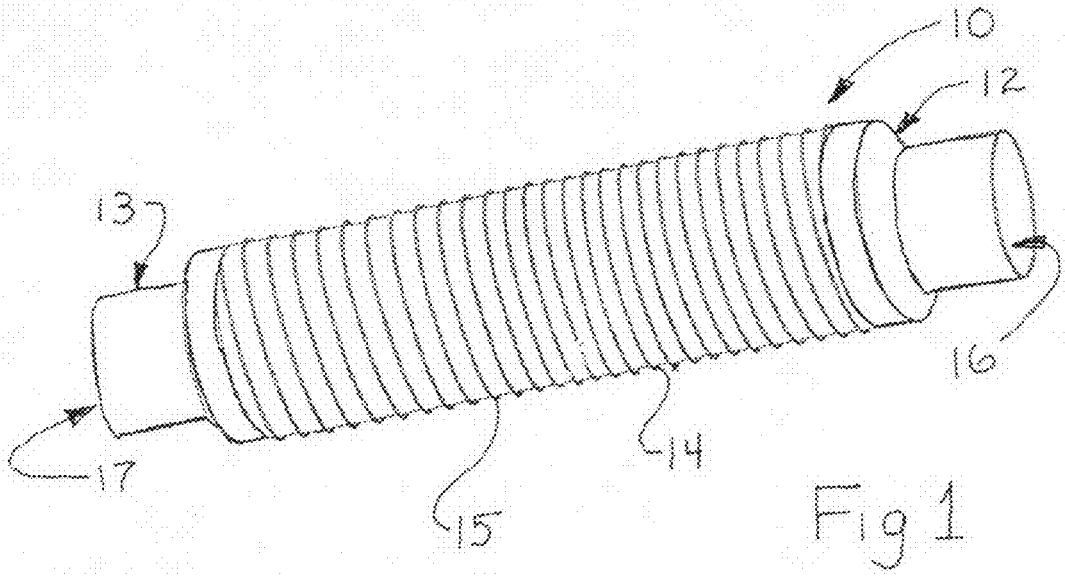
FIG. 1 sets forth a perspective view of a muffler fabricated in accordance with the present invention.

FIG. 1 sets forth a perspective view of a flexible muffler constructed in accordance with the present invention and generally referenced by numeral 10. Flexible muffler 10 is fabricated of a generally cylindrical flexible body 11 having an outer layer 14 upon which a reinforcing cord 15 is helically wound. In the fabrication of the present invention set forth and described below in greater detail, reinforcing cord 15 is adhesively joined to outer layer 14 of flexible body 11. Flexible muffler 10 further includes pair of substantially identical end caps 12 and 13 secured to opposed ends of flexible body 11. The fabrication and structural features of flexible muffler 10 are set forth below and described in detail. However, suffice it to note here that flexible muffler 10 is readily positioned within the duct system of an aircraft environmental control system by simply inserting end caps 12 and 13 into the ducts of an environmental control system. While not seen in FIG. 1, it will be understood that suitable clamping apparatus are employed in such attachment. In further accordance with the intended use of flexible muffler 10, end caps 12 and 13 define respective air passages 16 and 17 there through. As is better seen in FIG. 2, flexible body 11 also defines an internal muffler passage 18 extending between passages 16 and 17.

Figure 4:
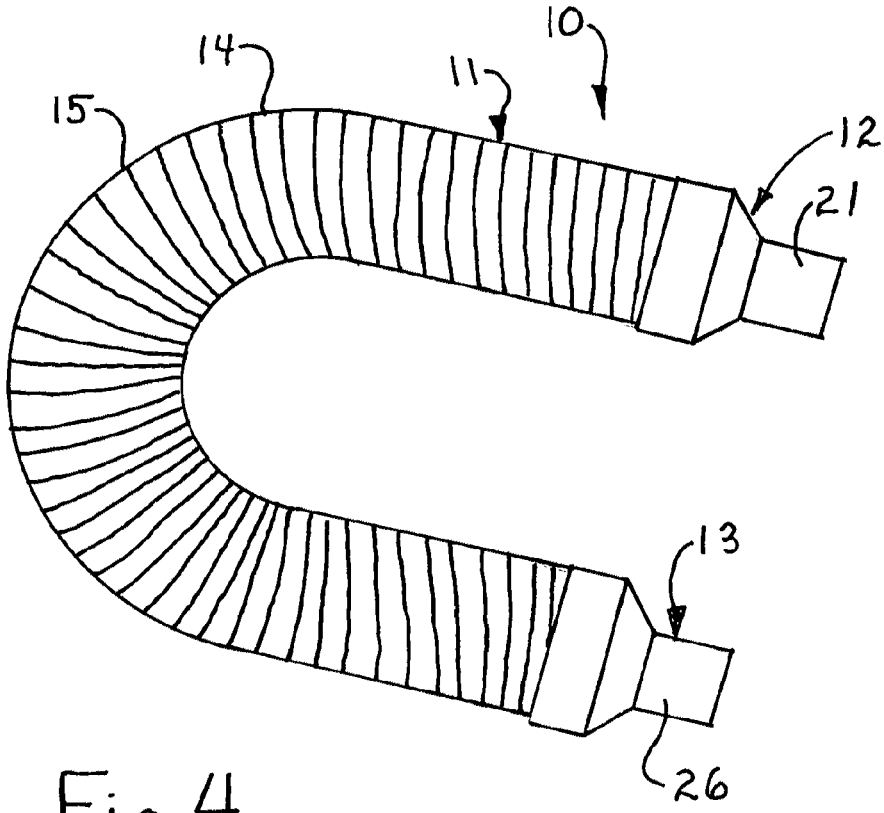
FIG. 4 sets forth the present invention muffler bent to a general U-shape.
Figure 5:
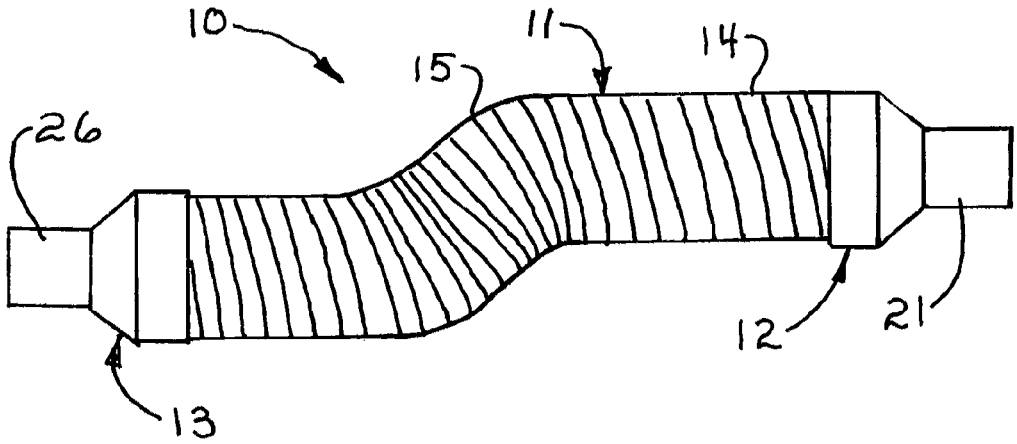
FIG. 5 sets forth the present invention muffler bent to accommodate an offset pathway.

In operation, with end caps 12 and 13 secured to a host duct system of an aircraft environmental control system (not shown), air flowing through flexible muffler 10 is allowed to pass through muffler 10 virtually unobstructed. However, by means set forth below in greater detail, sound energy or acoustic energy within the air flow is absorbed by flexible body 11. In further accordance with the present invention and is illustrated in FIGS. 4 and 5 below, flexible muffler 10 may be readily flexed or bent to different shapes to suit and accommodate the environment within the host aircraft through which flexible muffler 10 extends. In further accordance with the present invention, reinforcing cord 15 as well as a similar interior reinforcing cord 32 (seen in FIG. 2) cooperate to maintain the unrestricted cross section of flexible body 11 despite substantial curvature bending and flexing of flexible muffler 10. It will be understood by those skilled in the art that the illustration of flexible muffler 10 shown in FIG. 1 is not intended to indicate any limitation on the length of flexible body 11. Rather, it will be apparent to those skilled in the art from the descriptions which follow that flexible body 11 may be fabricated in different lengths with end caps 12 and 13 joined thereto to form correspondingly different lengths for flexible muffler 10.

Figure 2:
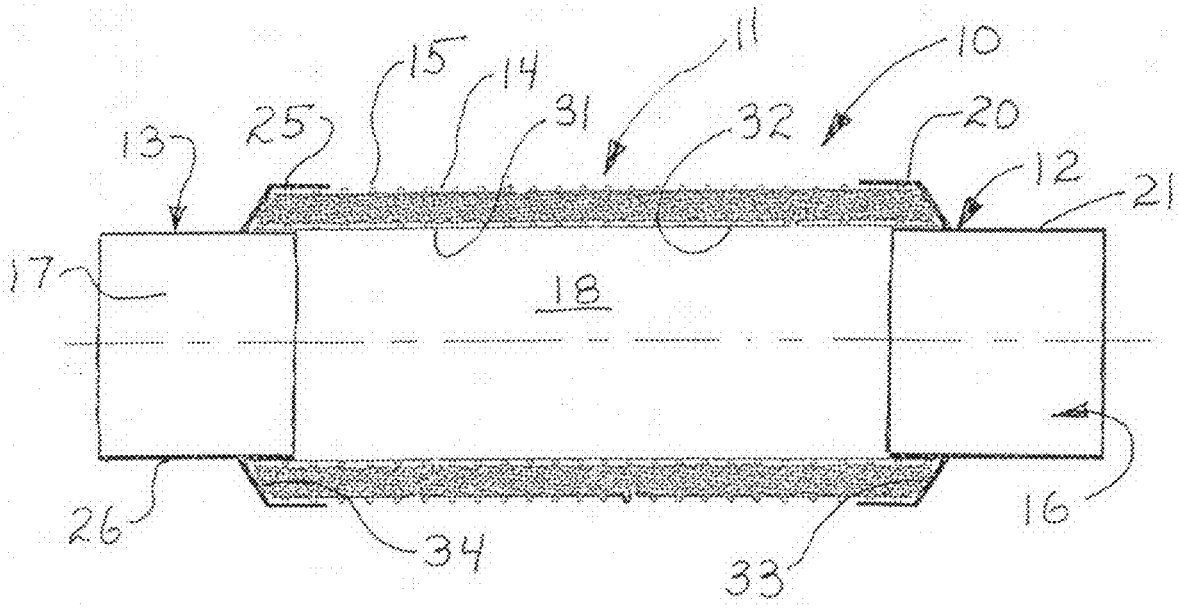
FIG. 2 sets forth a section view of the muffler of FIG. 1.

FIG. 2 sets forth a section view of flexible muffler 10 showing the structural details thereof. As described above, flexible muffler 10 includes a flexible body 11 supporting end caps 12 and 13 on each end thereof. As is also described above, flexible body 11 includes an outer layer 14 upon which reinforcing cord 15 is helically wound and joined to layer 14 by an adhesive attachment. Flexible body 11 further includes an inner layer 31 upon which a reinforcing cord 32 is helically wound. Reinforcing cord 32 is joined to inner layer 31 by adhesive attachment. As can be seen, inner layer 31 is of somewhat smaller diameter than outer layer 14 and thus a space is formed there between. In accordance with the present invention, the space between inner layer 31 and outer layer 14 is filled with an acoustic absorbent material 30 which in the manner described below is wrapped upon inner layer 31 and reinforcing cord 32 and which receives outer layer 14 and reinforcing cord 15 about its exterior. The cylindrical structure of flexible body 11 defines an interior muffler passage 18 extending entirely through flexible body 11.

As is also described above, end caps 12 and 13 are joined to opposed ends of flexible body 11. In the preferred fabrication of the present invention, end caps 12 and 13 are formed of a relatively stiff flexible material such as rubber or plastic or the like. End cap 12 defines a generally cylindrical sleeve 21 sized to fit within the interior of muffler passage 18. Sleeve 21 defines an air passage 16 extending there through which communicates with muffler passage 18. End cap 12 further includes an upwardly and extending outer lip 20 joined to and extending from sleeve 21. An end channel 33 is formed between outer lip 20 and the interior portion of sleeve 21. End channel 33 receives one end of flexible body 11. Similarly, end cap 13 which is substantially identical to end cap 12 defines a cylindrical sleeve 26 having a passage 17 extending there through. Passage 17 communicates with muffler passage 18. End cap 13 further includes an outer lip 25 extending from sleeve 26 and forming an end channel 34 there between. End channel 34 receives the remaining end of flexible body 11. In the preferred fabrication of the present invention, the end portions of flexible body 11 received within end channels 33 and 34 of end caps 12 and 13 respectively are adhesively secured and sealed therein.

In the preferred fabrication of the present invention, outer layer 14 is preferably formed of an air impervious material to maintain the air tight seal of flexible muffler 10. While a variety of materials may be utilized without departing from the spirit and scope of the present invention, it has been found particularly advantageous to fabricate outer layer 14 from a electrostatically treated sheet of a flouropolymer material such as the material manufactured and sold by DuPont Corporation under the trademark FEP TEFLON having a thickness of approximately 0.002 inches. This fluoropolymer material has been found to exhibit excellent tear strength and is extremely light in weight. In the anticipated fabrication of outer layer 14 described below in greater detail, the sheet of flouropolymer material is formed into a cylindrical tube having an overlapping seam therein. The electrostatic etching or treating of both surfaces of the polymer sheet material facilitates the joining of overlapping portions of the tube thus formed by adhesive attachment.

In the preferred fabrication of the present invention described below, inner layer 31 is formed of a porous layer such that sound energy is able to travel through inner layer 31 and is thus ultimately absorbed by acoustic absorbing material 30. While a variety of porous woven materials may be utilized to form inner layer 31, it has been found particularly advantageous in the fabrication of the present invention flexible muffler to utilize a knitted nomex material formed into a cylindrical sleeve and having reinforcing cord 32 helically wound thereon and adhesively joined thereto. The adhesive attachments of the opposed ends of flexible body 11 within end channels 33 and 34 of end caps 12 and 13 respectively maintains the air tight seal of passages 16 and 17 and muffler passage 18 required for use within an air flow duct system.

In operation, flexible muffler 10 is secured within a host environmental system by conventional attachment to connecting sleeves 21 and 26 (not shown). This attachment may utilize a variety of well-known connecting apparatus with the essential requirement being the air tight coupling of flexible muffler 10 within the cooperating ducts of the environmental control system. Thereafter, as conditioned air is forced through flexible muffler 10 the open passage provided by muffler passage 18 provides a very low resistance path for low pressure air being pumped through the environmental control system. In accordance with an important aspect of the present invention, acoustic energy within or carried by the air flowing through flexible muffler 10 passes through porous inner layer 31 of flexible body 11 and is absorbed within acoustic absorbing material 30. It will be recalled that outer layer 14 is air tight or impervious and thus any air passing through porous inner layer 31 and into acoustic absorbing material 30 is confined by outer layer 14 and is maintained within flexible muffler 10.

In accordance with a further important aspect of the present invention, flexible muffler 10 is capable of substantial bending or flexing without constricting muffler passage 18 due to the stiffness of helically wound reinforcing cords 32 and 15. It has been found that the use of thin cylindrical layers 14 and 31 together with reinforcing cord adhesive joined to each layer provides substantial flexibility while maintaining sufficient strength to avoid collapsing or distortion of muffler passage 18 when flexible muffler 10 is bent or curved. While a variety of reinforcement cord materials may be utilized without departing from the spirit and scope of the present invention, it has been found advantageous to utilize a polymer cord material which is a self-reinforcing thermoplastic polymer such as a polymer manufactured and sold by Solvay Advanced Polymers under the trademark Primospire SRP. It has been found that such reinforcing thermoplastic polymer materials exhibit sufficient stiffness and strength while contributing substantially less weight to the helical winding component of the present invention. In the anticipated fabrication of the present invention, the diameters of reinforcing cord material anticipated may vary between 0.025 and 0.120 inches in diameter with typical cord diameters being between 0.038 and 0.050 inches. This reinforcing cord provides high tensile strength and sufficient stiffness to maintain the cylindrical character of flexible muffler 10 when flexed or bent and thereby avoids restriction or closure of muffler passage 18 as flexible muffler 10 is flexed and bent in a typical aircraft installation.

Figure 3:
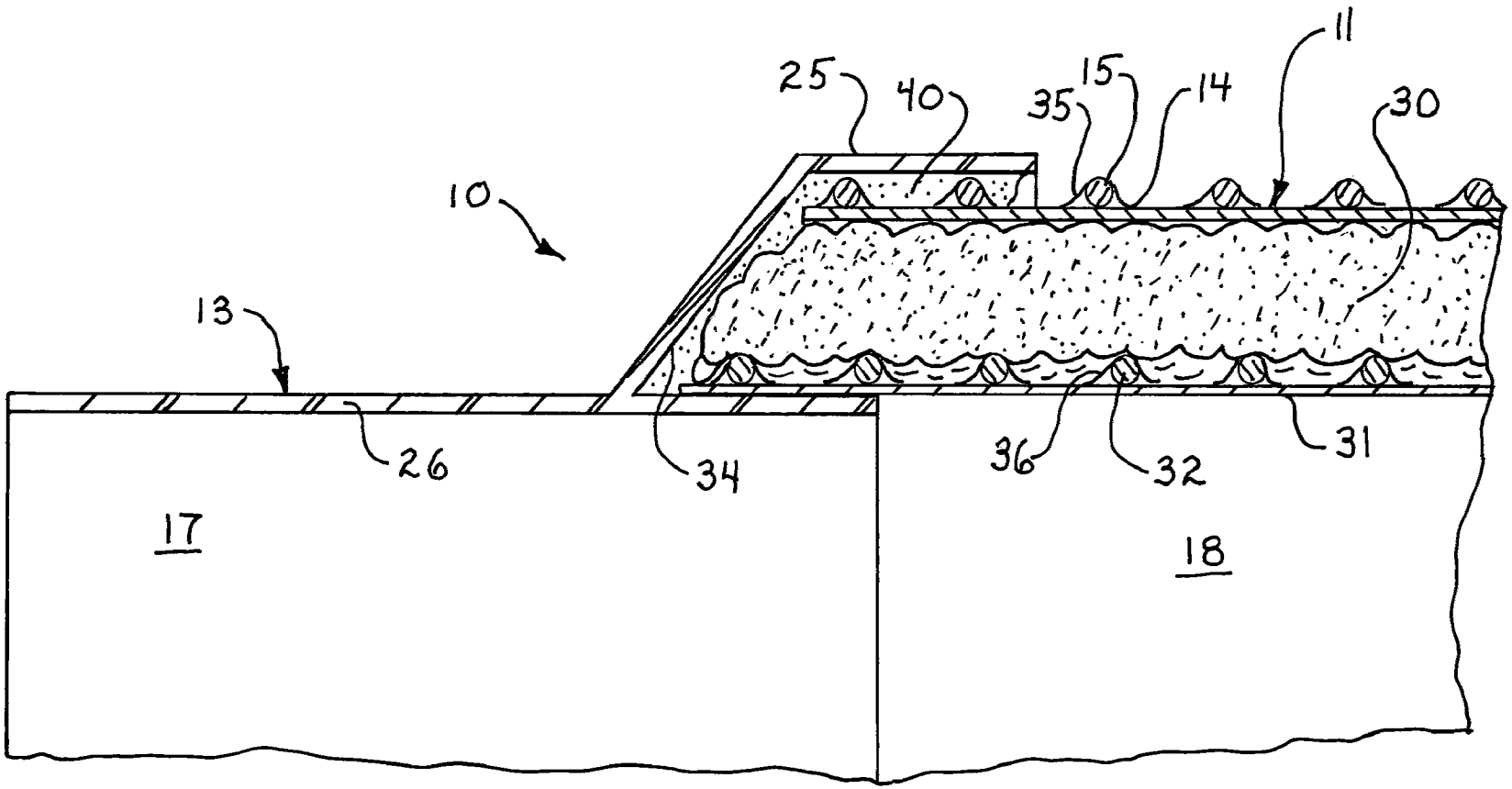
FIG. 3 sets forth an enlarged partial section view of the present invention muffler.

FIG. 3 sets forth an enlarged partial section view of flexible muffler 10 showing the attachment of flexible body 11 to end cap 13. It will be understood that flexible body 11 is similarly attached to end cap 12 (seen in FIG. 2). As described above, flexible muffler 10 includes a flexible body 11 secured to an end cap 13. As is also described above, end cap 13 includes a connecting sleeve 26 and an integrally formed outer lip 25. Lip 25 is spaced from the interior portion of connecting sleeve 26 to form an end chamber 34 which receives the end portion of flexible body 11. As is also described above, flexible body 11 includes a porous inner layer 31 upon which a reinforcing cord 32 is helically wound. Reinforcing cord 32 is adhesively secured to inner layer 31 by an adhesive 36. A quantity of acoustic absorptive material 30 is wrapped upon inner layer 31 and helically wound cord 32 to provide acoustic absorptive material. An outer layer 14 formed of an air impervious flouropolymer material encloses acoustic absorptive material 30. Reinforcing cord 15 is helically wound about outer layer 14 and joined thereto by an adhesive material forming adhesive attachment 35. The air tight character of flexible muffler 10 is maintained by the use of a sealing adhesive 40 within end channel 34 which is placed within end channel 34 so as to maintain an air tight seal between flexible body 11 and end cap 13.

Acoustic absorptive material 30 is utilized to receive and absorb acoustic energy within or carried by the air flow through flexible muffler 10. Accordingly, it will be recognized that a variety of acoustic absorptive materials may be utilized for material 30 without departing from the spirit and scope of the present invention. However, it has been particularly advantageous to utilize a fiberglass batting or melamine foam or other suitable absorptive material. In particular, a material manufactured by Johns Manville Corporation under the trademark Microlite. It will be further recognized that a variety of high-strength high-elongation adhesive materials may be utilized to adhesively secure reinforcing cords 15 and 32 to outer layer 14 and inner layer 31 respectively without departing from the spirit and scope of the present invention. However, it has been found particularly advantageous to utilize a high-strength high-elongation silicone adhesive manufactured by NuSil Corporation under the trademark NUSIL 32/2186.

FIG. 4 sets forth a top view of flexible muffler 10 having been bent in a generally U-shaped configuration to illustrate the flexible capabilities of the present invention muffler. Thus, as described above flexible muffler 10 includes a flexible body 11 having an outer layer 14 upon which a reinforcing cord 15 is helically wound and adhesively secured. As is also described above, flexible muffler 10 includes a pair of identical end caps 12 and 13 having connecting sleeves 21 and 26. FIG. 4 illustrates extreme bending of flexible muffler 10 such as would be required in extreme environments within the host aircraft to route the ducting apparatus of the environmental control system through and around various constrictions and obstacles. Of importance to note with respect to the present invention is that despite this extreme bending, the present invention flexible muffler maintains its generally cylindrical air passage character without constriction of the flexible body and air passage therein.

FIG. 5 sets forth a further example of the present invention flexible muffler being bent and flexed to accommodate a difficult pathway through various restrictions and obstacles of a host aircraft (not shown). Thus, as described above flexible muffler 10 includes a flexible body 11 having an outer layer 14 upon which a reinforcing cord 15 is helically wound and adhesively secured. As is also described above, flexible muffler 10 includes end caps 12 and 13 having connecting sleeves 21 and 26 respectively. In the example of FIG. 5, flexible muffler 10 has been formed in a generally S-shaped configuration to illustrate the bending and flexing of the present invention muffler to move within a restricted environment with a host aircraft (not shown). Once again, the important aspect to realize in FIG. 5 is the manner in which the present invention flexible muffler may be bent and/or flexed without constricting the interior air flow passages and the generally cylindrical shape thereof.

Figure 6:
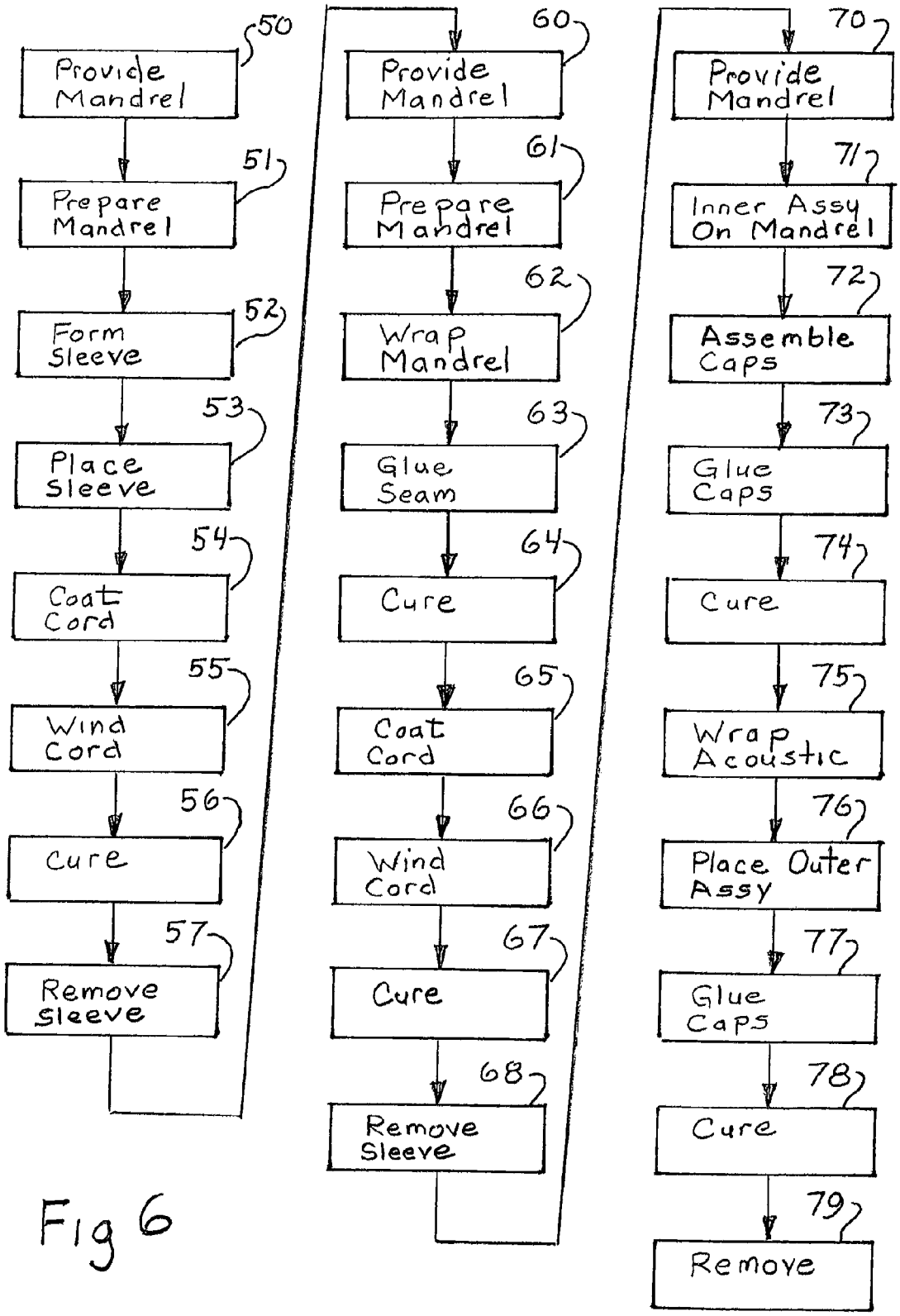
FIG. 6 sets forth a flow diagram of the present invention method of muffler fabrication.

FIG. 6 sets forth a flow diagram of the inventive method by which the present invention flexible muffler is fabricated. By way of overview, the present invention method includes steps 50 through 57 by which the inner layer assembly composed of inner layer 31 and reinforcing cord 32 (seen in FIG. 3) is assembled. Steps 60 through 68 set forth the assembly of an outer layer assembly comprised of outer layer 14 and reinforcing cord 15 (seen in FIG. 3). Finally, steps 70 through 79 set forth the assembly of the present invention flexible muffler in which the inner layer assembly is combined with acoustic absorbent material 30 (seen in FIG. 3) together with the outer layer assembly and end caps 12 and 13 (also seen in FIG. 3).

More specifically, the present invention assembly begins at step 50 in which a suitable cylindrical mandrel is provided. Thereafter, at step 51 a Kevlar material sleeve is placed upon the mandrel. Thereafter, at step 52 a sleeve of nomex or other porous material is provided. Next, at step 53 the sleeve of nomex material is placed upon the Kevlar prepared mandrel. At step 54, a quantity of reinforcing cord coated with adhesive material is provided. Thereafter, at step 55 the adhesively coated reinforcing cord is helically wound upon the porous sleeve. At step 56 the adhesive binding the reinforcing cord to the porous sleeve is cured at an elevated temperature. Once cured, at step 57 the inner layer assembly formed of the porous sleeve and adhesively attached reinforcing cord is removed and the Kevlar material is separated.

The fabrication of the outer layer assembly begins at step 60 providing a mandrel which is sufficiently greater in diameter than the mandrel provided at step 50 forming the inner layer assembly in order to fabricate an outer layer assembly having sufficient spacing from the inner layer to support acoustic absorptive material. At step 61, a Kevlar sleeve is applied to the mandrel after which at step 62 and sheet of electrostatically treated flouropolymer material is wrapped upon the mandrel so as to produce an overlapping seam. At step 63, the overlapping seam of flouropolymer material is adhesively joined. At step 64, the seam adhesive attachment is cured at elevated temperature. Thereafter, at step 65 a quantity of adhesive coated reinforcing cord is provided. At step 66, the adhesive coated reinforcing cord is helically wound upon the flouropolymer sleeve. At step 67, the assembly is cured at elevated temperature and at step 68 the resulting outer layer assembly is removed and the Kevlar material is separated therefrom.

At step 70, a mandrel is provided and at step 71 the inner layer assembly is placed upon the mandrel. At step 72, a pair of end caps are assembled to the inner layer assembly and at step 73, the end portions of the inner layer assembly and end caps are adhesively joined. At step 74, the attachment of the end caps to the inner layer assembly is cured at room temperature. Thereafter, at step 75 a quantity of acoustic absorptive material is wrapped upon the inner layer and positioned to extend into the end caps. At step 76, the outer layer assembly is placed upon the acoustic absorptive material and positioned within the end caps. At step 77, the end caps and outer layer are adhesively joined to provide an air tight seal. At step 78, the resulting assembled is cured at room temperature and at step 79 the completed flexible muffler is removed from the mandrel.

What has been shown is a novel flexible muffler for use in an aircraft environmental control system which reduces overall system weight while simultaneously improving the strength and flammability resistance of the duct system. Concurrently, the present invention flexible muffler exhibits substantial improvement in combustion related properties and thus provides enhanced safety for passengers and crew within the host aircraft in the event of an aircraft fire. The sound absorbing qualities of the flexible muffler and the ease of which the muffler may be bent or flexed to accommodate spacial restrictions and limitations within the host aircraft combine to provide a substantial increase in the efficiency and effectiveness of the aircraft environmental system.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in an aircraft environmental control system, a flexible muffler comprising:

a pair of duct connectors;

an inner sleeve formed into a cylinder having a single length-wise seam and defining a first outer surface and formed of a sound pervious material having opposed ends joined to said duct connectors and defining a muffler passage therethrough;

a first helix of reinforcing cord wound solely upon and adhesively joined adhesively to said first outer surface of said inner sleeve;

a layer of acoustic absorptive material upon said inner sleeve and said first helix of reinforcing cord;

an outer sleeve formed into a cylinder having a single length-wise seam and defining a second outer surface and formed of an air impervious material having opposed ends joined to said duct connectors and forming a seal therewith; and a second helix of reinforcing cord wound solely upon and adhesively joined solely to said second outer surface outer sleeve, said inner and outer sleeves and said first and second helixes of reinforcing cord cooperating to maintain said muffler passage in an open state when said flexible muffler is flexed or bent.

2. The flexible muffler set forth in claim 1 wherein said outer sleeve is formed of a sheet of electrostatically etched fluoropolymer shaped to a generally cylindrical shape having said overlapping longitudinal seam joined by adhesive bonding.

3. The flexible muffler set forth in claim 2 wherein said inner sleeve is formed of an air pervious material.

4. The flexible muffler set forth in claim 3 wherein said inner sleeve is formed of a woven material.

5. The flexible muffler set forth in claim 4 wherein said outer sleeve is formed of FEP TEFLON.

6. The flexible muffler set forth in claim 5 wherein said first and second helixes of reinforcing cord are formed of polymer cord.

7. The flexible muffler set forth in claim 6 wherein said polymer cord is formed of a self-reinforcing thermoplastic polymer.

8. The flexible muffler set forth in claim 7 wherein said acoustic absorptive material includes a melamine foam.

* * * * *